US011293294B2

(12) United States Patent
Knortz

(10) Patent No.: US 11,293,294 B2
(45) Date of Patent: Apr. 5, 2022

(54) SPEED-CONTROLLED CONDITIONING VALVE FOR HIGH PRESSURE COMPRESSOR

(71) Applicant: Raytheon Technologies Corporation, Farmington, CT (US)

(72) Inventor: Christopher J. Knortz, West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/881,687

(22) Filed: May 22, 2020

(65) Prior Publication Data

US 2021/0363894 A1 Nov. 25, 2021

(51) Int. Cl.

| | |
|---|---|
| ***F01D 11/00*** | (2006.01) |
| ***F01D 17/10*** | (2006.01) |
| ***F01D 5/08*** | (2006.01) |

(52) U.S. Cl.

CPC ..... *F01D 11/005* (2013.01); *F01D 5/082* (2013.01); *F01D 5/087* (2013.01); *F01D 11/006* (2013.01); *F01D 17/105* (2013.01); *F05D 2240/24* (2013.01); *F05D 2260/606* (2013.01); *F05D 2270/00* (2013.01)

(58) Field of Classification Search

CPC ..... F01D 5/066; F01D 5/081; F01D 5/082; F01D 5/085; F01D 5/087; F01D 5/088; F01D 11/005; F01D 11/006; F01D 11/025; F01D 17/105; F01D 11/003; F04D 25/045; F04D 29/582; F04D 29/584; F02C 7/28; F05D 2240/55–59; F05D 2260/606

USPC ..... 137/53–58

See application file for complete search history.

(56) References Cited

U.S. PATENT DOCUMENTS

| | | | |
|---|---|---|---|
| 3,712,756 | A | 1/1973 | Kalikow et al. |
| 4,543,038 | A | 9/1985 | Kitaguchi |
| 4,741,153 | A | 5/1988 | Hallinger et al. |
| 5,472,313 | A | 12/1995 | Quinones et al. |
| 6,428,272 | B1 | 8/2002 | Pepi et al. |

(Continued)

FOREIGN PATENT DOCUMENTS

EP 2617941 A1 * 7/2013 ..... F04D 29/584

OTHER PUBLICATIONS

European Application No. 21175454.4 filed May 21, 2021; European Search Report dated Nov. 11, 2021; 7 pages.

*Primary Examiner* — Christopher R Legendre

(74) *Attorney, Agent, or Firm* — Cantor Colburn LLP

(57) ABSTRACT

A rotor for a gas turbine engine has: a first rotor disk; an interstage flange that extends from the first rotor disk to a flange end portion that has an axial end surface and first radial outer and inner surfaces; a circumferential groove, formed in the flange end portion and extending from the axial end surface toward the first rotor disk; radial outer and inner slots formed in the first radial outer and inner surfaces along the circumferential groove and extend through the first radial outer and inner surfaces; and a valve member disposed within the circumferential groove and is secured within the circumferential groove when the flange end portion is connected to a second rotor disk, wherein the valve member deflects from rotor rotational speeds to seal or unseal the radial outer slot.

20 Claims, 7 Drawing Sheets

(56) References Cited

U.S. PATENT DOCUMENTS

| | | | | |
|---|---|---|---|---|
| 8,137,072 | B2 * | 3/2012 | Kim | F01D 11/006 416/193 A |
| 8,419,270 | B2 | 4/2013 | Wawrzonek et al. | |
| 2006/0239812 | A1 | 10/2006 | Friedel et al. | |
| 2016/0076381 | A1 | 3/2016 | Suciu et al. | |
| 2017/0191568 | A1 | 7/2017 | Kaslin | |

* cited by examiner

SPEED-CONTROLLED CONDITIONING VALVE FOR HIGH PRESSURE COMPRESSOR

BACKGROUND

Exemplary embodiments pertain to the art of valves and more specifically to a speed-controlled conditioning valve for high pressure compressor of a gas turbine engine.

During engine accelerations, compressive stress conditions may be induced in outer rim features of rotors due to rapid temperature change. These conditions may exist in both bladed rotor configurations, i.e., where blades are attached to rotors, and integrated blade rotor ("IBR") configurations. Gas path temperatures may increase faster than the rotor can absorb the temperatures, and heat conducted in the rotor may cause a temperature gradient between the gas path and the rest of the rotor, which may reduce a total life of the rotor. Stress conditions can also be induced in an opposite direction, if the rotor rim is cooling faster than the bores. This may happen during a fast deceleration of the engine, when the engine is in a high power state and goes to idle state.

Gas path air may be used to mitigate the thermal gradient between a rotor outer dimeter ("OD") rim and a rotor body by flowing gas path air into rotor inner dimeter ("ID") cavities, adjacent to rotor bores and blade webs. In known flow metering systems, such as that used for controlled cooling of turbine blades, actuation of a valve member may be performed using a relatively large device (such as a Bellville washer). In addition, in known conditioning flow systems, air can flow constantly through the engine cycle. During maximum temperature conditions, such as that which occurs during peak engine output, the constant cooling flow can have negative impacts on the creep properties of the rotor webs, degrading the life of the parts. A constant flow condition also has negative impacts on the performance parameters of the engine, efficiency, thrust.

BRIEF DESCRIPTION

Disclosed is a rotor for a gas turbine engine, including: a first rotor disk; an interstage flange that extends in an axial direction from the first rotor disk to a flange end portion, the flange end portion having an axial end surface and first radial outer and inner surfaces; a circumferential groove, formed in the flange end portion and extending axially from the axial end surface toward the first rotor disk; radial outer and inner slots are respectively formed in the first radial outer and inner surfaces along the circumferential groove, respectively radially extending through the first radial outer and inner surfaces; and a valve member disposed within the circumferential groove, the valve member being secured within the circumferential groove when the flange end portion is connected to a second rotor disk, when the rotor is rotating below a predetermined speed, the valve member is in a first deflected state, the radial outer and inner slots being unsealed when the valve member is in the first deflected state, and when the rotor is rotating above the predetermined speed, the valve member is in a second deflected state, the radial outer slot being sealed by the valve member when the valve member is in the second deflected state.

In addition to one or more of the above disclosed features for the rotor, or as an alternate, the valve member includes deflectable and stationary valve portions respectively located thereon; and the valve member is located in the circumferential groove so that the deflectable valve portion engages the radial outer and inner slots.

In addition to one or more of the above disclosed features for the rotor, or as an alternate, the circumferential groove defines a first shape between the first radial outer and inner surfaces, and the stationary valve portion is formed with a second shape defined by second radial outer and inner surfaces that is complementary to the first shape; and the deflectable valve portion is formed with a third shape defined by third radial outer and inner surfaces, wherein the third shape is formed to taper in a radial direction toward a circumferential end of the valve member.

In addition to one or more of the above disclosed features for the rotor, or as an alternate, the second radial outer surface defines a first radius having a first radial center, and the third radial outer surface defines a second radius having a second radial center, wherein the first and second radial centers are in different locations; and the second and third radial inner surfaces define a same radius as each other and have a same radial center location as each other.

In addition to one or more of the above disclosed features for the rotor, or as an alternate, the second radius is smaller than the first radius.

In addition to one or more of the above disclosed features for the rotor, or as an alternate, an effective circumferential length of the deflectable valve portion decreases with deflection of the deflectable valve portion during rotation of the rotor, and wherein a resonant frequency of the deflectable valve portion is defined by $$F = \frac{K_n}{2\pi}\sqrt{\frac{E*I}{q*L^4}}$$

where E=Young's Modulus, I=an area of inertia of the deflectable valve portion, L=the effective circumferential length of the deflectable valve portion, q=a distribution of mass of the deflectable valve portion, Kn=a modal constant for the deflectable valve portion, and F=a frequency of response for the deflectable valve portion.

In addition to one or more of the above disclosed features for the rotor, or as an alternate, the flange end portion has connector holes; and the radial outer and inner slots are circumferentially offset from the connector holes.

In addition to one or more of the above disclosed features for the rotor, or as an alternate, the circumferential groove is an annular groove; and the valve member is a conical ring, or a plurality of layered conical rings, having a radial smaller end and a radial larger end, when the rotor is at rotating above the predetermined speed, the radial smaller end of the valve member is deflected radially outward, the radial outer slot being sealed by the valve member when the radial smaller end of the valve member is deflected radially outward.

In addition to one or more of the above disclosed features for the rotor, or as an alternate, the circumferential groove is a first circumferential groove, and wherein the rotor comprises: the second rotor disk, the second rotor disk including first and second axial outer surfaces that are axially opposite to each other on the second rotor disk and a second circumferential groove extending axially from the first axial outer surface toward the second axial outer surface, wherein the first and second circumferential grooves are radially aligned when the first and second rotor disks are connected to each other, and wherein the valve member has a valve member axial length that is longer than the first circumferential groove so that the valve member extends between the first and second circumferential grooves when the first and second rotor disks are secured to each other.

Further disclosed is a gas turbine engine, including: a rotor that includes: a first rotor disk; an interstage flange that extends in an axial direction from the first rotor disk to a flange end portion, the flange end portion having an axial end surface and first radial outer and inner surfaces; a circumferential groove, formed in the flange end portion and extending axially from the axial end surface toward the first rotor disk; radial outer and inner slots are respectively formed in the first radial outer and inner surfaces along the circumferential groove, respectively radially extending through the first radial outer and inner surfaces; and a valve member disposed within the circumferential groove, the valve member being secured within the circumferential groove when the flange end portion is connected to a second rotor disk, and when the rotor is rotating below a predetermined speed, the valve member is in a first deflected state, the radial outer and inner slots being unsealed when the valve member is in the first deflected state, and when the rotor is rotating above the predetermined speed, the valve member is in a second deflected state, the radial outer slot being sealed by the valve member when the valve member is in the second deflected state.

In addition to one or more of the above disclosed features for the engine, or as an alternate, the valve member includes deflectable and stationary valve portions; and the valve member is located in the circumferential groove so that the deflectable valve portion engages the radial outer and inner slots.

In addition to one or more of the above disclosed features for the engine, or as an alternate, the circumferential groove defines a first shape between the first radial outer and inner surfaces, and the stationary valve portion is formed with a second shape defined by second radial outer and inner surfaces that is complementary to the first shape; and the deflectable valve portion is formed with a third shape defined by third radial outer and inner surfaces, wherein the third shape is formed to taper in a radial direction toward a circumferential end of the valve member.

In addition to one or more of the above disclosed features for the engine, or as an alternate, the second radial outer surface defines a first radius having a first radial center, and the third radial outer surface defines a second radius having a second radial center, wherein the first and second radial centers are in different locations; and the second and third radial inner surfaces define a same radius as each other and have a same radial center location as each other.

In addition to one or more of the above disclosed features for the engine, or as an alternate, the second radius is smaller than the first radius.

In addition to one or more of the above disclosed features for the engine, or as an alternate, an effective circumferential length of the deflectable valve portion decrease with deflection of the deflectable valve portion during rotation of the rotor, and wherein a resonant frequency of the deflectable valve portion is defined by $$F = \frac{K_n}{2\pi}\sqrt{\frac{E*I}{q*L^4}}$$

where E=Young's Modulus, I=an area of inertia of the deflectable valve portion, L=the effective circumferential length of the deflectable valve portion, q=a distribution of mass of the deflectable valve portion, Kn=a modal constant for the deflectable valve portion, and F=a frequency of response for the deflectable valve portion.

In addition to one or more of the above disclosed features for the engine, or as an alternate, the flange end portion has connector holes; and the radial outer and inner slots are circumferentially offset from the connector holes.

In addition to one or more of the above disclosed features for the engine, or as an alternate, the circumferential groove is an annular groove; and the valve member is a conical ring, or a plurality of layered conical rings, having a radial smaller end and a radial larger end, when the rotor is at rotating above the predetermined speed, the radial smaller end of the valve member is deflected radially outward, the radial outer slot being sealed by the valve member when the radial smaller end of the valve member is deflected radially outward.

In addition to one or more of the above disclosed features for the engine, or as an alternate, the circumferential groove is a first circumferential groove, and wherein the rotor comprises: the second rotor disk, the second rotor disk including first and second axial outer surfaces that are axially opposite to each other on the second rotor disk, a second circumferential groove extending axially from the first axial outer surface toward the second axial outer surface, wherein the first and second circumferential grooves being radially aligned when the first and second rotor disks are connected to each other, and wherein the valve member has a valve member axial length that is longer than the first circumferential groove so that the valve member extends between the first and second circumferential grooves when the first and second rotor disks are secured to each other.

In addition to one or more of the above disclosed features for the engine, or as an alternate, the engine includes a low pressure compressor and a high pressure compressor, wherein the rotor is a high pressure compressor rotor.

Further disclosed is a method of directing conditioning air through a rotor of a gas turbine engine, including: rotating the rotor below a predetermined speed so that a valve member located in a circumferential groove formed in the rotor is in a first deflected state, and radial outer and inner slots respectively formed in first radial outer and inner surfaces surrounding the circumferential groove are unsealed; and rotating the rotor above the predetermined speed so that the valve member is in a second defected state and the radial outer slot is sealed by the valve member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
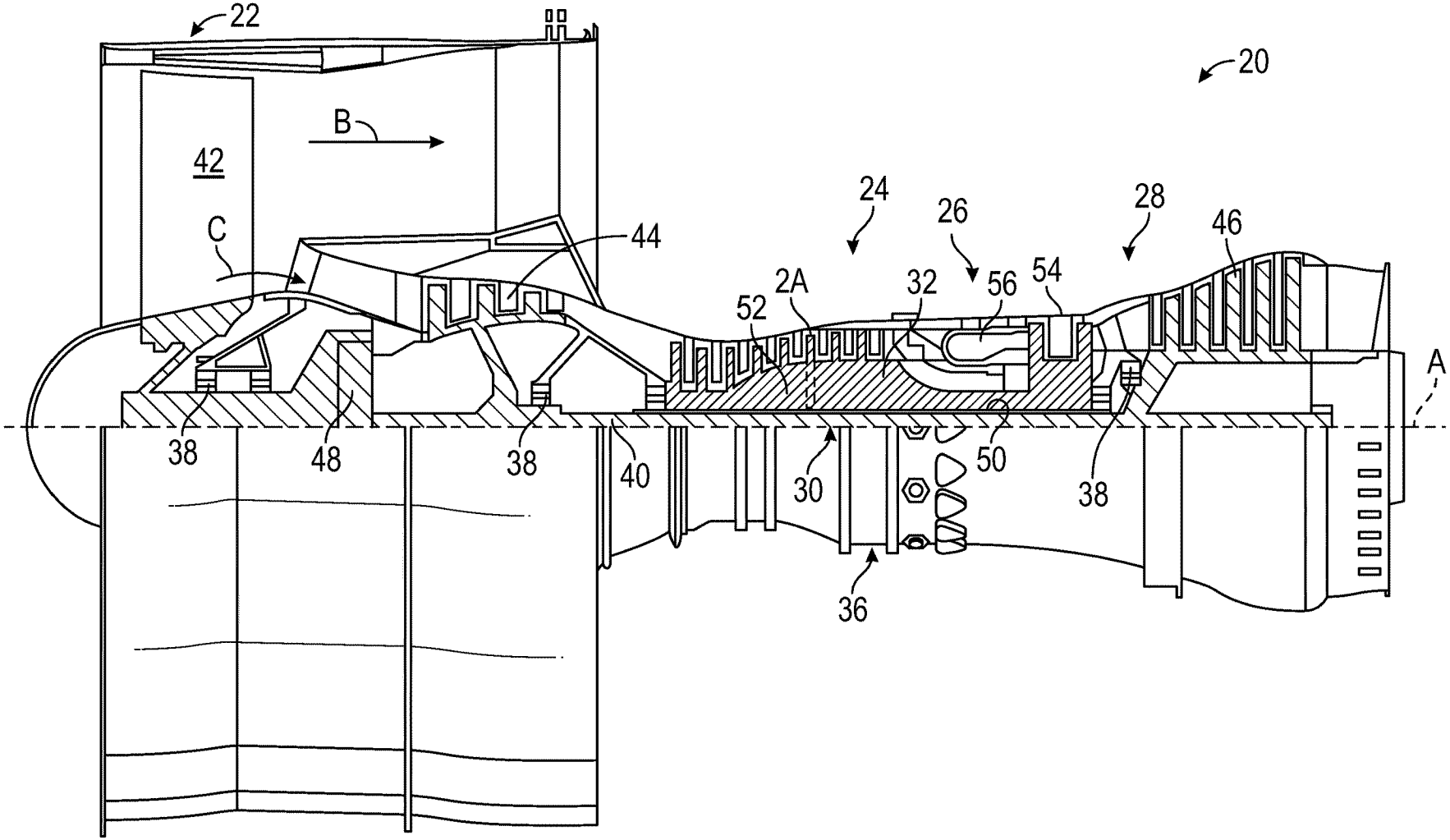
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A (engine radial axis R is also illustrated in FIG. 1) relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft. (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2B:
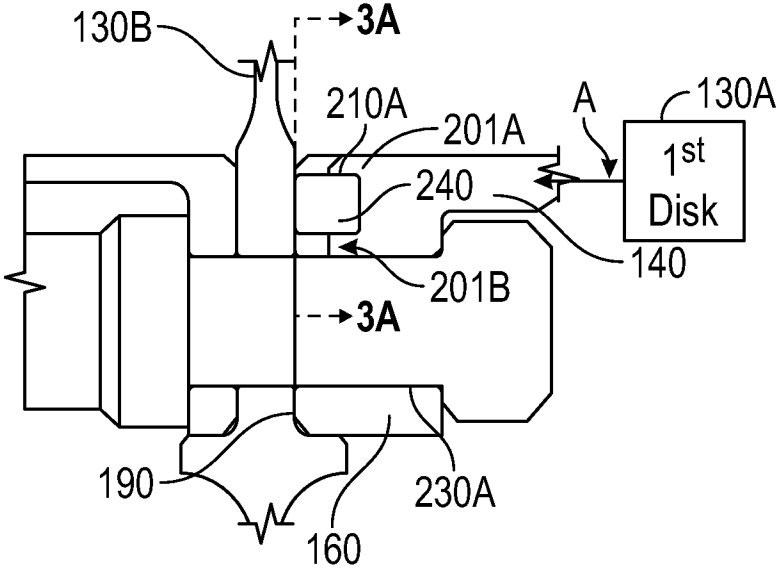
FIG. 2B is a further view of a portion of the rotor in section 2B of FIG. 2A showing a valve member in a groove formed in a flange end portion of an interstage flange of a disk.
Figure 2A:
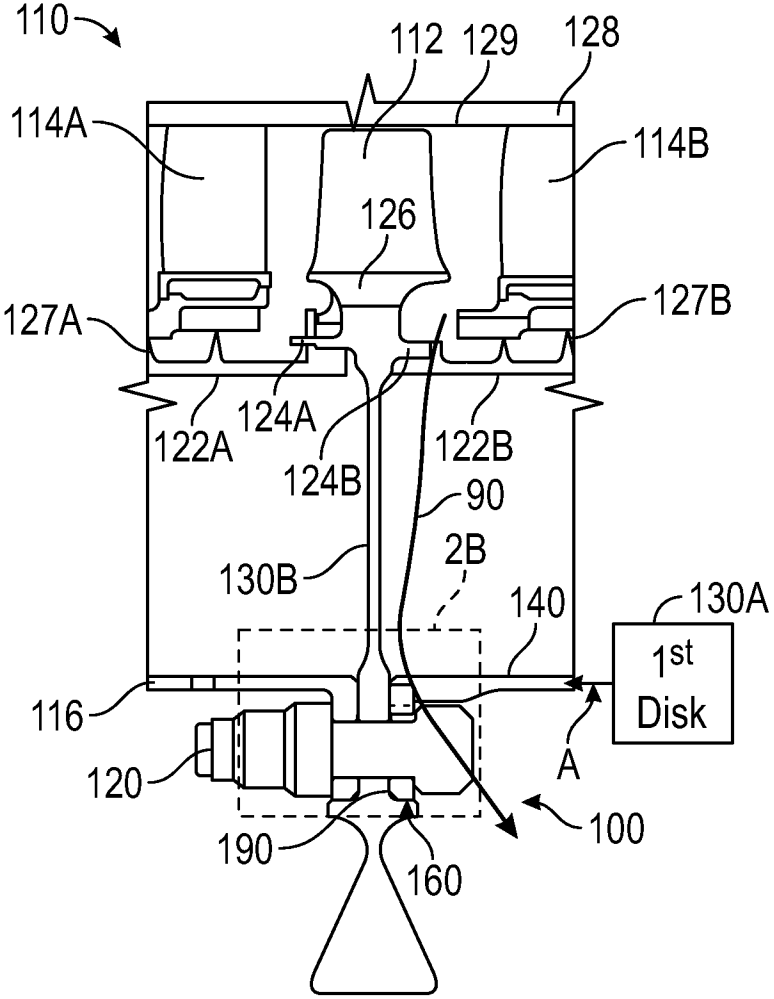
FIG. 2A is a view of a portion of a rotor in section 2A of FIG. 1.

As shown in FIG. 2A, in the high pressure compressor 52 of the engine 20, a conditioning flow 90 of gas path air may be used to condition an inner diameter (ID) cavity 100 of the rotor stack (rotor) 110. The conditioning flow will heat or cool engine cavities depending on when the air is flowing in the engine cycle. The disclosed embodiments, discussed in greater detail below, enable reducing the conditioning flow 90 during maximum engine operating conditions, when such conditioning flow 90 could be damaging to engine components. As a result, the disclosed embodiments increase the life of the engine parts. The disclosed embodiments also provide a compact form factor for a rotor bolted flange or rotor snap interface. The disclosed embodiments also provides means to improve engine efficiency and thrust-specific fuel consumption (TSFC) compared to open flow condition.

As shown in FIGS. 2A and 2B, the rotor 110 includes a first rotor disk 130A. An interstage flange 140 extends in the axial direction A from the first rotor disk 130A to a flange end portion 160. The flange end portion 160 having an axial end surface 190 and first radial outer and inner surfaces 201A, 201B.

Also shown in FIG. 2A is a blade 112 axially surrounded by a pair of vanes 114A, 114B. Another interstage flange 116 connects with the interstage flange 140 and a second rotor disk 130B supporting the blade 112 via a bolt connector 120. Additional outer diameter interstage flanges 122A, 122B connect via snap flanges 124A, 124B to a rim 126 of the blade 112. Each of the outer diameter interstage flanges 122A, 122B may include knife seals 127A, 127B. A case structure 128 supports the vanes 114A, 114B and blade outer air seals 129.

As shown in FIGS. 3A-3D, a (first) circumferential groove 210A is formed in the flange end portion 160 and extending axially from the axial end surface 190 toward the first rotor disk 130A. Radial outer and inner slots 220A, 220B are respectively defined in the first radial outer and inner surfaces 201A, 201B along the circumferential groove 210A, extending radially through the respective first radial outer and inner surfaces 201A, 201B. The radial outer and inner slots 220A, 220B allow a path flow for the conditioning flow 90. The radial outer and inner slots 220A, 220B, are formed (or cut) circumferentially between flange connector (bolt) holes 230A, 230B connecting the first and second rotor disks 130A, 130B.

A valve member 240 is disposed within the circumferential groove 210A. The valve member 240 is secured within the circumferential groove 210A when the flange end portion 160 is connected to the second rotor disk 130B. The rotor 110 is rotating below a predetermined speed (e.g., measured in rotations per minute, or RPM), the valve member 240 is in a first deflected state. From this configuration the radial outer and inner slots 220A, 220B are unsealed. When the rotor 110 is rotating above the predetermined speed, the valve member 240 is in a second deflected state. In this configuration, the radial outer slot 220A is sealed. Thus, the disclosed embodiments provide for passively actuating the valve member 240 to deflect, elastically, with rotational speed of the compressor rotor (rotor) 110 (e.g., the valve member 240 is speed-controlled), to restrict conditioning flow 90.

The valve member 240 includes deflectable (or actuatable) and stationary valve portions 260A, 260B. The valve member 240 is located in the circumferential groove 210A so that the deflectable valve portion 260A engages the radial outer and inner slots 220A, 220B.

The circumferential groove 210A defines a first shape between the first radial outer and inner surfaces 201A, 201B. The stationary valve portion 260B is formed with a second shape defined by second radial outer and inner surfaces 202A, 202B, that is complementary to the first shape. The deflectable valve portion 260A is formed with a third shape defined by third radial outer and inner surfaces 203A, 203B. The third shape is formed to taper in a radial direction toward a circumferential end 270 of the valve member 240.

The second radial outer surface 202A defines a first radius 280A having a first radial center 280B. The third radial outer surface 203A defines a second radius 290A having a second radial center 290B. The first and second radial centers 280B, 290B are disposed in different locations. The second and third radial inner surfaces 202B, 203B define a same radius as each other and have a same radial center location as each other. In one embodiment, the second radius 290A is smaller than the first radius 280A.

The second and third radial outer surfaces 202A, 203A of the deflectable and stationary valve portions 260A, 260B are tangent to each other where they meet. As indicated, a shape and curvature of the deflectable valve portion 260A is such that it deflects against the radial outer slot 220A at a desired rotational speed to enable an increase in engine efficiency and a decrease in rotor stress.

With the disclosed embodiments, the stationary valve portion 260B is fixed in the circumferential groove 210A to prevent circumferential motion of the valve member 240 relative to the circumferential groove 210A. The deflectable valve portion 260A has a shape that is tuned or optimized to provide valve actuation at pre-determined engine speed ranges.

A radial height of the valve member 240 may be, e.g., 0.250 in (inches). The height would be dictated by the stiffness needed to accomplish the correct valve actuation (deflection) in the deflectable valve portion 260A. A flow area through the radial outer and inner slots 220A, 220B, is less than five percent (5%), and as low as one percent (1%) of engine core flow. A circumferential span of the radial outer and inner slots 220A, 220B and/or a number of the slots may be selected to achieve the desired conditioning flow.

Figure 3A:
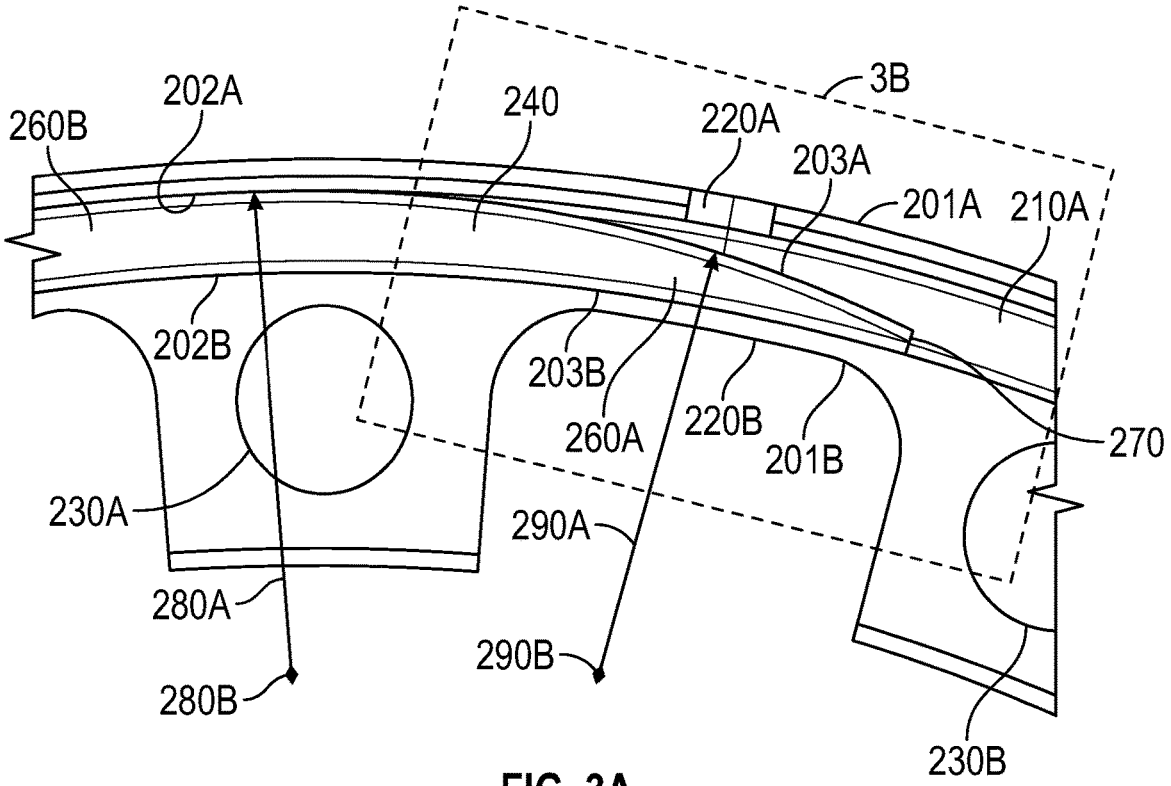
FIG. 3A is a further view of the portion of the rotor along section lines 3A-3A in FIG. 2B, showing the valve member in the groove of the flange end portion.
Figure 3B:
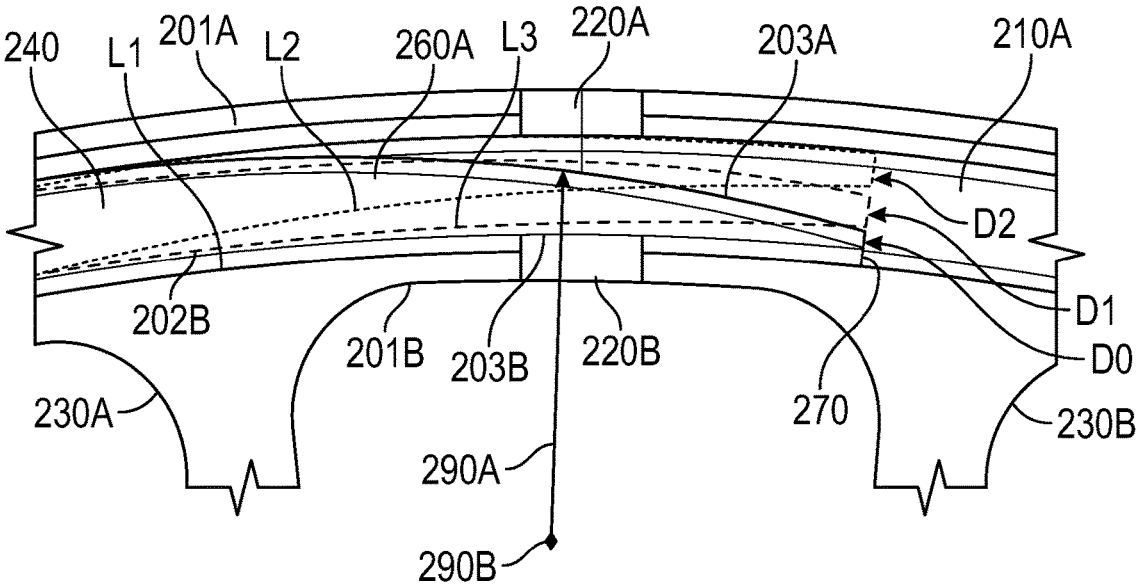
FIG. 3B is a further view of the portion of the rotor in section 3B of FIG. 3A, showing the valve member in different deflected positions within the groove of the flange end portion.
Figure 3C:
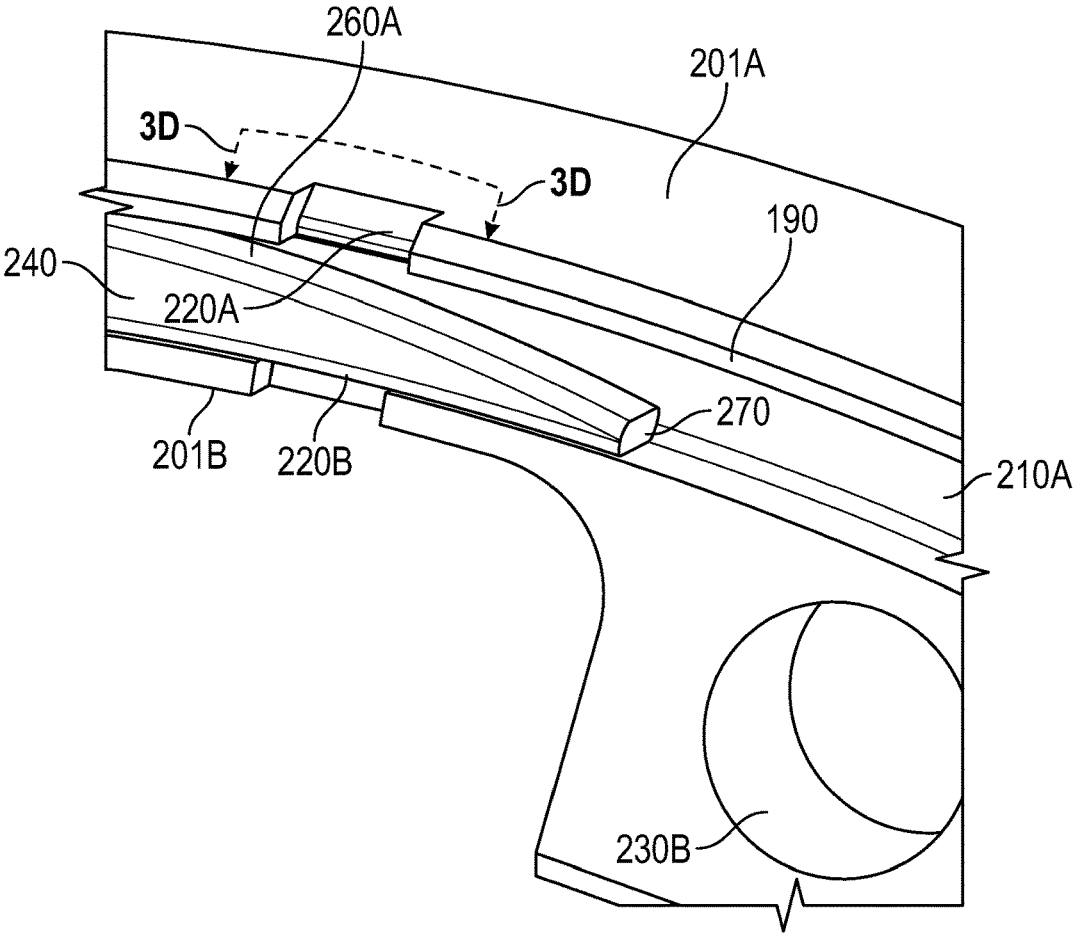
FIG. 3C is perspective view of the portion of the rotor in section 3B of FIG. 3A.
Figure 3D:
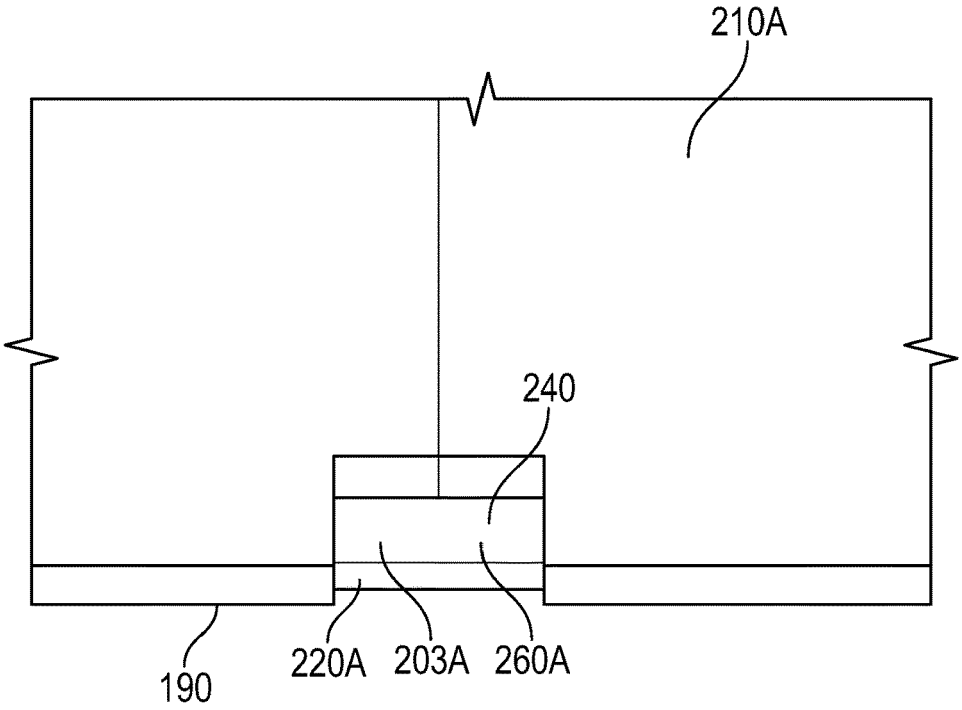
FIG. 3D is a further view of the portion of the rotor along section lines 3D-3D in section 3C, showing the valve member through a radial outer slot in the flange end portion.

As shown in FIG. 3B, as the deflectable valve portion 260A deflects, the effective circumferential length of the deflectable valve portion 260A changes. This is due to a change in the second radius 290A of the third radial outer surface 203A during deflection of the deflectable valve portion 260A. For example the effective circumferential length is L1 when of the deflectable valve portion 260A is against the radial inner slot 220B, e.g., when the engine 20 is not running. This is shown as a non-deflected state D0 in FIG. 3B. When the engine is running at a max output, and the deflectable valve portion 260A is against the radial outer slot 220A, and effective circumferential length is L2, which differs from L1. This is shown as a second deflected state D2 in FIG. 3B. At low speeds or intermediate speeds, between idle and the maximum output, the effective circumferential length of the deflectable valve portion 260A is L3. That is, L3 is variable between L1 and L2 and is a function of the speed of the engine 20 and design characteristics of the valve member 240. This is shown as a first deflected state D1 in FIG. 3B. In FIG. 3B, the leader lines for L1-L3 touch upon the third inner radial surface 203B for the deflectable valve portion 260A in each respective deflected state D1-D3.

The deflection response of the deflectable valve portion 260A can be adjusted by design of the valve member 240 to provide the conditioning flow 90 for the engine 20. That is, by design, below a threshold rotational speed, the first deflected state D1 of the valve member 240 allows conditioning flow 90 through the radial outer and inner slots 220A, 220B. Above the threshold, the valve member 240 is in the second deflected state D2 that results in closing off the radial outer slot 220A, preventing the further flow of the condition flow 90. Thus, the disclosed configuration meters conditioning air based on rotational speed of the compressor 52.

Figure 4A:
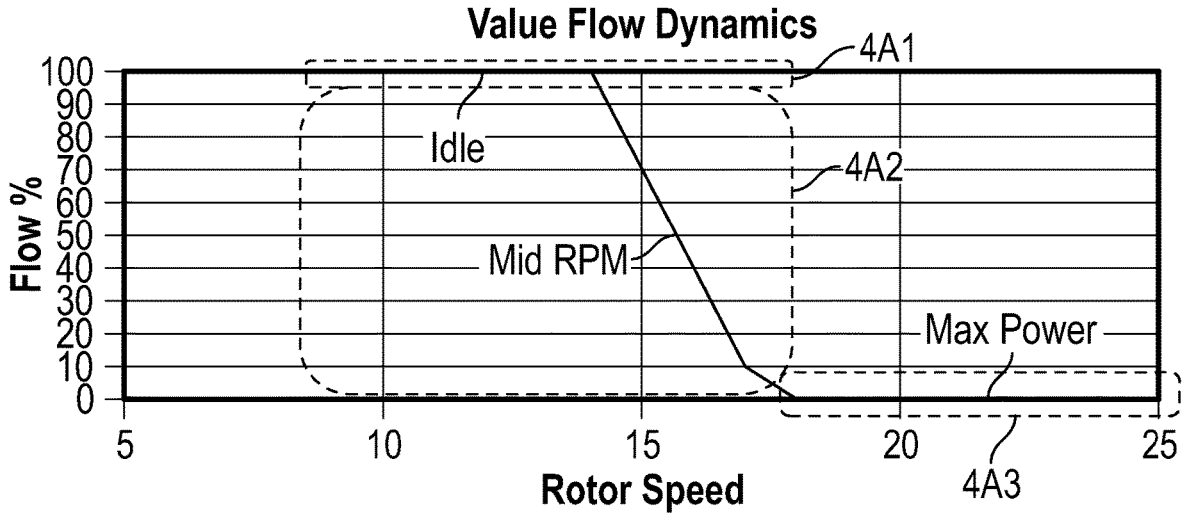
FIG. 4A shows flow dynamics around the valve member based on rotor speed, due to a deflection (or bending) of a deflection portion of the valve member.

The conditioning flow may be most effective at a low power condition for the engine 20. Thus, as shown in FIG. 4A, as the high pressure compressor 52 increases in speed, the conditioning flow 90 is reduced and eventually closed off, due to the deflection of the valve member 240. The flow curve 4A1 shows flow around the deflectable valve portion 260A when the engine is at idle and the deflectable valve portion 260A is in the first deflected state D1 (FIG. 3B), and conditioning flow will be at a relative maximum.

The flow curve 4A2 shows flow around the deflectable valve portion 260A when the engine is operating in a speed range of between idle and maximum engine output. During this engine operational state, the deflectable valve portion 260A will also be in the first deflected state D1 (FIG. 3B), though the deflection of the deflectable valve portion 260A will increase as engine output, and compressor rotation, increases. That is, during this middle-range engine rotational speed (between idle and a maximum engine output), the valve member 240 may deflect (or bend) toward the radial outer slot 220A, limiting conditioning flow through it.

The flow curve 4A3 shows flow around the deflectable valve portion 260A when the engine 20 is near or at a maximum engine output. During this engine operational state, the deflectable valve portion 260A will be in the second deflected state D2 (FIG. 3B), shutting off the conditioning flow 90.

Figure 4B:
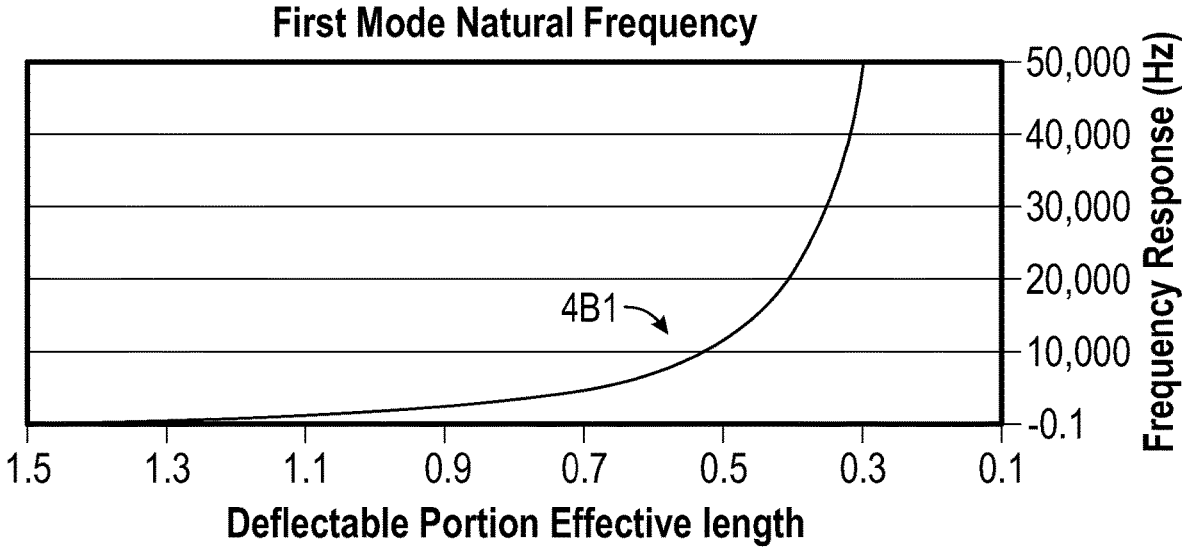
FIG. 4B shows a frequency of response (resonant frequency) of the deflection portion based on an effective circumferential length of the deflectable valve portion, wherein the effective circumferential length changes as a function of its deflection.

Turning to FIG. 4B, during operation of the engine, an undamped (resonant or first mode) response may occur in the deflectable valve portion 260A of the valve member 240 as labeled in curve 4B1. This may cause damage to the valve member 240. That is, the deflectable valve portion 260A functions as a cantilevered beam, and a frequency of response is therefore determined by a frequency response formula:

$$F = \frac{K_n}{2\pi}\sqrt{\frac{E*I}{q*L^4}}$$

In the frequency response formula, E=Young's Modulus, I=an area of inertia of the deflectable valve portion, L=the effective circumferential length of the deflectable valve portion, q=a distribution of mass of the deflectable valve portion, Kn=a modal constant for the deflectable valve portion, and F=a frequency of response for the deflectable valve portion. Thus, the frequency of response is tied to the effective circumferential length and changes as a function of the engine speed. Therefore, the vibration mode of the deflectable valve portion 260A also changes based on engine speed. To address unwanted vibrations, the second radius 290A or the second radial center 290B of the deflectable valve portion 260A may be shifted, or its shape may be modified to provide the desired frequency response and damp out the vibrations.

Figure 5A:
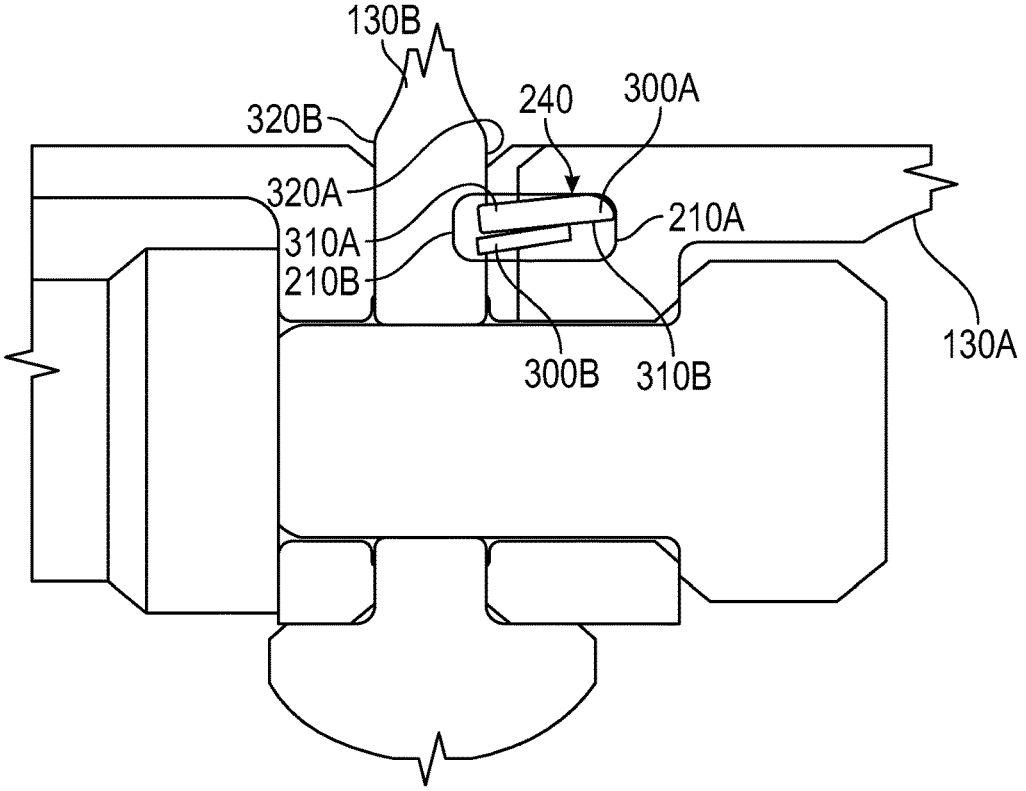
FIG. 5A shows an embodiment in which the valve member includes conical rings.
Figure 5B:
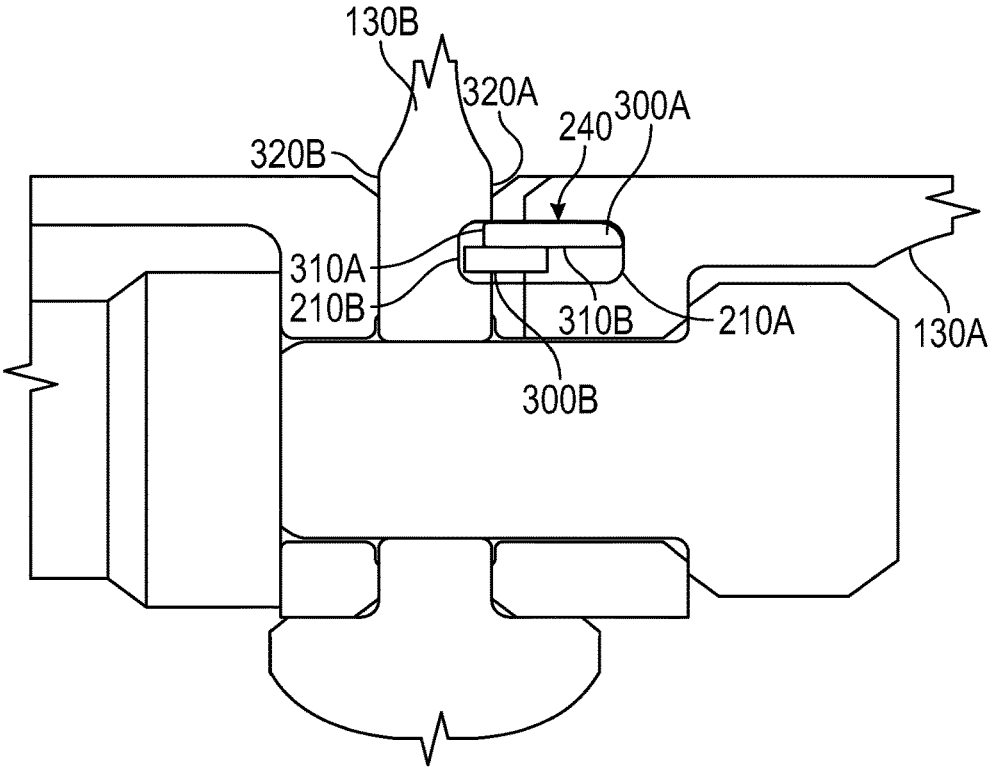
FIG. 5B shows an embodiment in which the valve member includes conical rings, where the conical rings are deflected to seal the radial outer slot.

Turning to FIGS. 5A and 5B, in another embodiment, a first ring 300A, having a full hooped (annular) conical shape, is utilized for the valve member 240. The first ring 300A has a radial smaller end 310A and a radial larger end 310B. When the rotor 110 is rotating above the predetermined speed, the radial smaller end 310A is deflected radially outward. In this configuration, the radial outer slot 220A is sealed by the valve member 240.

The first ring is placed in the circumferential groove 210A, which may also be a full hoop (annular) groove. The first ring 300A may have a conical angle, length, and thickness that define its stiffness. The first ring 300A may have an axial length that may be sufficient to fully cover the radial outer slot 220A when the first ring 300A is deflected (or passively actuated) during peak operating output conditions. The first ring 300A may be tuned (or formed) so that a deflection response of the first ring 300A changes in the axial direction A (FIG. 2A), conical angle and wall thickness for the ring.

Harmonic responses of the valve member 240 may be mitigated with a plurality of layered (conical) rings, including the first ring 300A and a second ring 300B. The first and second rings 300A, 300B, may be tuned (formed) to have different natural frequency from each other. Any delta (or difference) in the frequency response may generate friction absorbing vibratory energy.

In one embodiment, the second rotor disk 130B includes first and second axial outer surfaces 320A, 320B that are axially opposite to each other on the second rotor disk 130B. A second circumferential groove 210B extends axially from the first axial outer surface 320A toward the second axial outer surface 320B. The first and second circumferential grooves 210A, 210B are radially aligned when the first and second rotor disks 130A, 130B are connected to each other.

The valve member 240 in this embodiment, which may be a combination of the first and second rings 300A, 300B, may have an axial length that is longer than the first circumferential groove 210A. Thus, the valve member 240 overlaps the first and second circumferential grooves 210A, 210B when the first and second rotor disks 130A, 130B are secured to each other.

The utilization of the second ring 300B and the second circumferential grove 210B may make it easier for the valve member 240 to fully restrict the conditioning air flow due manufacturing tolerances between the first circumferential groove 210A and the first ring 300A. With the first and second circumferential grooves 210A, 210B extending axially into both rotor disks 130A, 130B, the tolerances can be absorbed.

Figure 6:
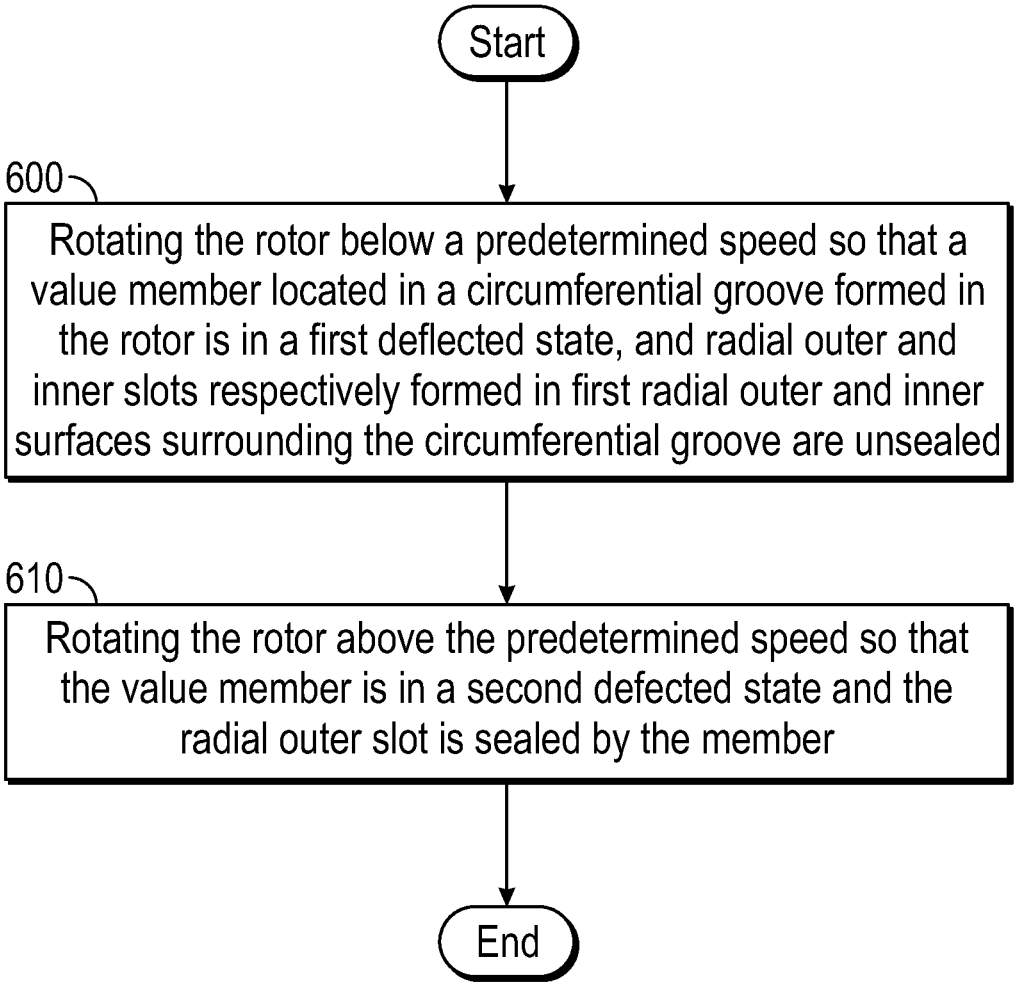
FIG. 6 is a flowchart showing a method of directing a conditioning flow through the rotor.

Turning to FIG. 6, further disclosed is a method of directing conditioning air through a rotor of a gas turbine engine. As shown in block 600, the method includes rotating the rotor 110 below a predetermined speed. In this operational state, the valve member 240, which is located in the circumferential groove 210A formed between first radial outer and inner surfaces 201A, 201B of the flange end portion 160 of the first rotor disk 130A, is in the first deflected state. Additionally, in this operational state, radial outer and inner slots 220A, 220B, respectively formed in the first radial outer and inner surfaces 201A, 201B, are unsealed. As shown in block 610, the method includes rotating the rotor 110 above the predetermined speed. In this operational state, the valve member 240 is in a second defected state and the radial outer slot 220A is sealed by the valve member 240.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A rotor for a gas turbine engine, comprising:

a first rotor disk and a second rotor disk;

an interstage flange that extends in an axial direction from the first rotor disk to a flange end portion, the flange end portion having an axial end surface and first radial outer and inner surfaces;

a circumferential groove, formed in the flange end portion and extending axially from the axial end surface toward the first rotor disk;

radial outer and inner slots are respectively formed in the first radial outer and inner surfaces along the circumferential groove, respectively radially extending through the first radial outer and inner surfaces; and a valve member disposed within the circumferential groove, the valve member being secured within the circumferential groove between the flange end portion and the second rotor disk, when the rotor is rotating below a predetermined speed, the valve member is in a first deflected state, the radial outer and inner slots being unsealed when the valve member is in the first deflected state, and when the rotor is rotating above the predetermined speed, the valve member is in a second deflected state, the radial outer slot being sealed by the valve member when the valve member is in the second deflected state.

2. The rotor of claim 1, wherein:

the valve member includes deflectable and stationary valve portions located thereon; and the valve member is located in the circumferential groove so that the deflectable valve portion engages the radial outer slot in the second deflected state and the radial inner slot in a non-deflected state of the valve member.

3. The rotor of claim 2, wherein:

the circumferential groove defines a first shape between the first radial outer and inner surfaces, and the stationary valve portion is formed with a second shape defined by second radial outer and inner surfaces that is complementary to the first shape; and the deflectable valve portion is formed with a third shape defined by third radial outer and inner surfaces, wherein the third shape is formed to taper in a radial direction toward a circumferential end of the valve member.

4. The rotor of claim 3, wherein:

the second radial outer surface defines a first radius having a first radial center, and the third radial outer surface defines a second radius having a second radial center, wherein the first and second radial centers are in different locations; and the second and third radial inner surfaces define a same radius as each other and have a same radial center location as each other.

5. The rotor of claim 4, wherein:

the second radius is smaller than the first radius.

6. The rotor of claim 5, wherein:

an effective circumferential length of the deflectable valve portion decreases with deflection of the deflectable valve portion during rotation of the rotor; and a resonant frequency F of the deflectable valve portion is defined by $$F = \frac{K_n}{2\pi}\sqrt{\frac{E*I}{q*L^4}}$$

where E=Young's Modulus, I=an area of inertia of the deflectable valve portion, L=the effective circumferential length of the deflectable valve portion, q=a distribution of mass of the deflectable valve portion, and Kn=a modal constant for the deflectable valve portion.

7. The rotor of claim 1, wherein:

the flange end portion has connector holes; and the radial outer and inner slots are circumferentially offset from the connector holes.

8. The rotor of claim 1, wherein:

the circumferential groove is an annular groove; and the valve member is a conical ring, or a plurality of layered conical rings, having a radial smaller end and a radial larger end, when the rotor is rotating above the predetermined speed, the radial smaller end of the valve member is deflected radially outward to the second deflected state, the radial outer slot being sealed by the valve member when the radial smaller end of the valve member is deflected radially outward to the second deflected state.

9. The rotor of claim 8, wherein the circumferential groove is a first circumferential groove, and wherein the second rotor disk includes first and second axial outer surfaces that are axially opposite to each other on the second rotor disk, and a second circumferential groove extending axially from the first axial outer surface toward the second axial outer surface, wherein the first and second rotor disks being connected to each other such that the first and second circumferential grooves are radially aligned, and wherein the valve member has a valve member axial length that is longer than the first circumferential groove so that the valve member extends between the first and second circumferential grooves.

10. A gas turbine engine, comprising: a compressor and a turbine;

a rotor that includes:

a first rotor disk and a second rotor disk, an interstage flange that extends in an axial direction from the first rotor disk to a flange end portion, the flange end portion having an axial end surface and first radial outer and inner surfaces, a circumferential groove, formed in the flange end portion and extending axially from the axial end surface toward the first rotor disk, radial outer and inner slots are respectively formed in the first radial outer and inner surfaces along the circumferential groove, respectively radially extending through the first radial outer and inner surfaces, and a valve member disposed within the circumferential groove, the valve member being secured within the circumferential groove between the flange end portion and the second rotor disk; and when the rotor is rotating below a predetermined speed, the valve member is in a first deflected state, the radial outer and inner slots being unsealed when the valve member is in the first deflected state, and when the rotor is rotating above the predetermined speed, the valve member is in a second deflected state, the radial outer slot being sealed by the valve member when the valve member is in the second deflected state.

11. The gas turbine engine of claim 10, wherein:

the valve member includes deflectable and stationary valve portions; and the valve member is located in the circumferential groove so that the deflectable valve portion engages the radial outer slot in the second deflected state and the radial inner slot in a non-deflected state of the valve member.

12. The gas turbine engine of claim 11, wherein:

the circumferential groove defines a first shape between the first radial outer and inner surfaces, and the stationary valve portion is formed with a second shape defined by second radial outer and inner surfaces that is complementary to the first shape; and the deflectable valve portion is formed with a third shape defined by third radial outer and inner surfaces, wherein the third shape is formed to taper in a radial direction toward a circumferential end of the valve member.

13. The gas turbine engine of claim 12, wherein:

the second radial outer surface defines a first radius having a first radial center, and the third radial outer surface defines a second radius having a second radial center, wherein the first and second radial centers are in different locations; and the second and third radial inner surfaces define a same radius as each other and have a same radial center location as each other.

14. The gas turbine engine of claim 13, wherein:

the second radius is smaller than the first radius.

15. The gas turbine engine of claim 14, wherein:

an effective circumferential length of the deflectable valve portion decreases with deflection of the deflectable valve portion during rotation of the rotor; and a resonant frequency F of the deflectable valve portion is defined by $$F = \frac{K_n}{2\pi}\sqrt{\frac{E*I}{q*L^4}}$$

where E=Young's Modulus, I=an area of inertia of the deflectable valve portion, L=the effective circumferential length of the deflectable valve portion, q=a distribution of mass of the deflectable valve portion, and Kn=a modal constant for the deflectable valve portion.

16. The gas turbine engine of claim 10, wherein:

the flange end portion has connector holes; and the radial outer and inner slots are circumferentially offset from the connector holes.

17. The gas turbine engine of claim 10, wherein:

the circumferential groove is an annular groove; and the valve member is a conical ring, or a plurality of layered conical rings, having a radial smaller end and a radial larger end, when the rotor is rotating above the predetermined speed, the radial smaller end of the valve member is deflected radially outward to the second deflected state, the radial outer slot being sealed by the valve member when the radial smaller end of the valve member is deflected radially outward to the second deflected state.

18. The gas turbine engine of claim 17, wherein the circumferential groove is a first circumferential groove, and wherein the second rotor disk includes first and second axial outer surfaces that are axially opposite to each other on the second rotor disk and a second circumferential groove extending axially from the first axial outer surface toward the second axial outer surface, wherein the first and second rotor disks being connected to each other such that the first and second circumferential grooves are radially aligned, and wherein the valve member has a valve member axial length that is longer than the first circumferential groove so that the valve member extends between the first and second circumferential grooves.

19. The gas turbine engine of claim 18, including a low pressure compressor and a high pressure compressor, wherein the rotor is a high pressure compressor rotor.

20. A method of directing conditioning air through a rotor of a gas turbine engine, wherein the rotor includes:

a first rotor disk and a second rotor disk;

an interstage flange that extends in an axial direction from the first rotor disk to a flange end portion, the flange end portion having an axial end surface and first radial outer and inner surfaces, a circumferential groove, formed in the flange end portion and extending axially from the axial end surface toward the first rotor disk, radial outer and inner slots respectively formed in the first radial outer and inner surfaces along the circumferential groove, respectively radially extending through the first radial outer and inner surfaces, and a valve member disposed within the circumferential groove, the valve member being secured within the circumferential groove between the flange end portion and the second rotor disk;

the method comprising:

rotating the rotor below a predetermined speed so that the valve member located in the circumferential groove formed in the rotor is in a first deflected state and the radial outer and inner slots respectively formed in the first radial outer and inner surfaces surrounding the circumferential groove are unsealed; and rotating the rotor above the predetermined speed so that the valve member is in a second deflected state and the radial outer slot is sealed by the valve member.

* * * * *